US005213122A

United States Patent [19]

Grady, II

[11] Patent Number: 5,213,122

[45] Date of Patent: May 25, 1993

[54] ELECTRIC UMBRELLA

[76] Inventor: Clyde C. Grady, II, P.O. Box 303, Baytown, Tex. 77522

[21] Appl. No.: 612,536

[22] Filed: Nov. 13, 1990

Related U.S. Application Data

[63] Continuation of Ser. No. 206,596, Jun. 14, 1988, abandoned.

[51] Int. Cl.[5] ..... A45B 25/14

[52] U.S. Cl. ..... 135/20.3; 135/22

[58] Field of Search ..... 135/22, 20 M, 20.3

[56] References Cited

U.S. PATENT DOCUMENTS

| | | | |
|---|---|---|---|
| 338,986 | 3/1886 | Leistner | 135/20 M |
| 3,129,715 | 4/1964 | Militano | 135/20 M |
| 3,213,868 | 10/1965 | Forbes | 135/20 M |
| 4,424,824 | 1/1984 | Becher | 135/20 M |
| 4,543,971 | 10/1985 | Sirota | 135/20 M |
| 4,572,226 | 2/1986 | Williams | 135/22 |
| 4,736,761 | 4/1988 | Warfield | 135/22 |
| 4,766,920 | 8/1988 | Grady | 135/22 |

*Primary Examiner*—Henry E. Raduazo

[57] ABSTRACT

This invention relates to umbrellas in general. In particular it relates to umbrellas which automatically open and close. This automatic opening and closing of the umbrella is accomplished by means of the rotation of a threaded rod or with force exerted by compressed gas.

The improvements disclosed herein relate to improved means for more economically controlling the source of motive power used to open and close the umbrella.

A key improvement disclosed herein include a means for conserving the power of the batteries used to power the motor which causes the threaded rod to open and close the umbrella embodiment utilizing this means of opening and closing.

An additional improvement disclosed is the use of a multiple lead threaded rod which avoids the binding and "cross-threading" of previous designs.

4 Claims, 11 Drawing Sheets

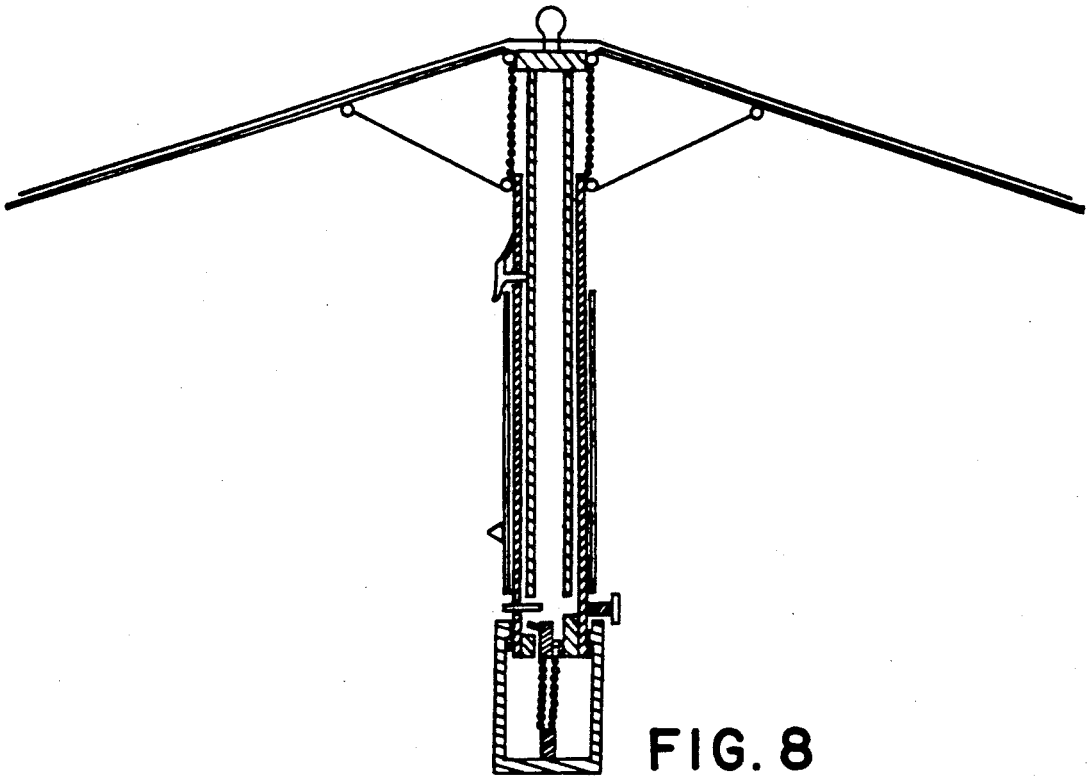
FIG. 8
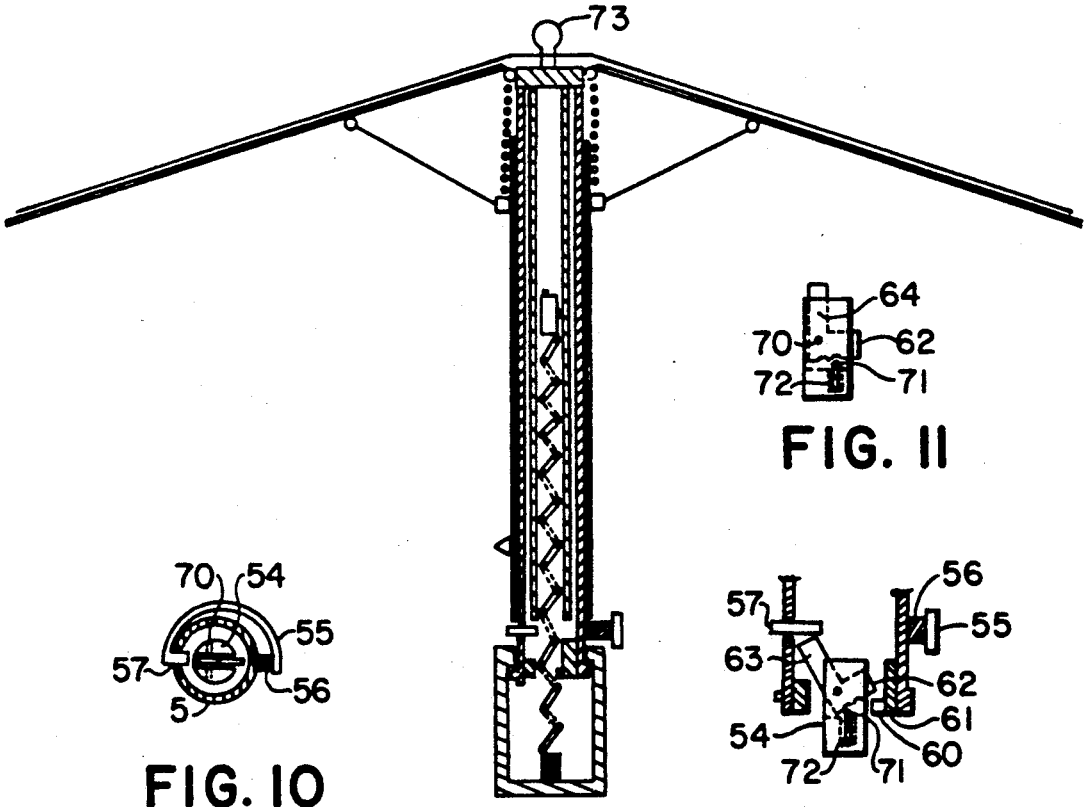
FIG. 9
FIG. 11
FIG. 10
FIG.12

ELECTRIC UMBRELLA

This is a continuation of application Ser. No. 07/206,596, filed Jun. 14, 1988, now abandoned.

BACKGROUND ART

It is known in the art to construct umbrellas which open automatically with the manual release of a catch wherein the compression of a spring causes a hollow member, to which the ribs of the umbrella are attached, to move along a shaft extending through the hollow member. It is also known in the art to provide means for the biasing closed of the umbrella by springs. However, the umbrellas of the art in general require the movement of the hand from one position to another in order to effect closing or even worse require the use of two hands. These defects are coupled with a complexity of design which contributes to a high cost of manufacture.

BRIEF DESCRIPTION OF DRAWINGS

FIGS. 5 through 9 are sectional views through an umbrella mechanism 51 wherein like-numbered items in FIGS. 1 through 4 and FIGS. 5 through 9 correspond to identical parts.

FIG. 10 is an enlarged detailed overhead view of spring latch 54 itself along with associated parts.

FIG. 11 is an enlarged elevational view of spring latch 54.

FIG. 12 is an enlarged sectional view of spring latch 54 taken from FIG. 6 showing how it interacts with catch 60.

FIG. 13 shows the umbrella in the so-called "closed" position.

In FIG. 1 can be seen umbrella ribs 10 held in an open position by umbrella struts 2 wherein umbrella ribs 10 rotate about pivot point 3, while strut 2 and rib 10 are attached one to the other at the second pivot point 4.

Figure 1:
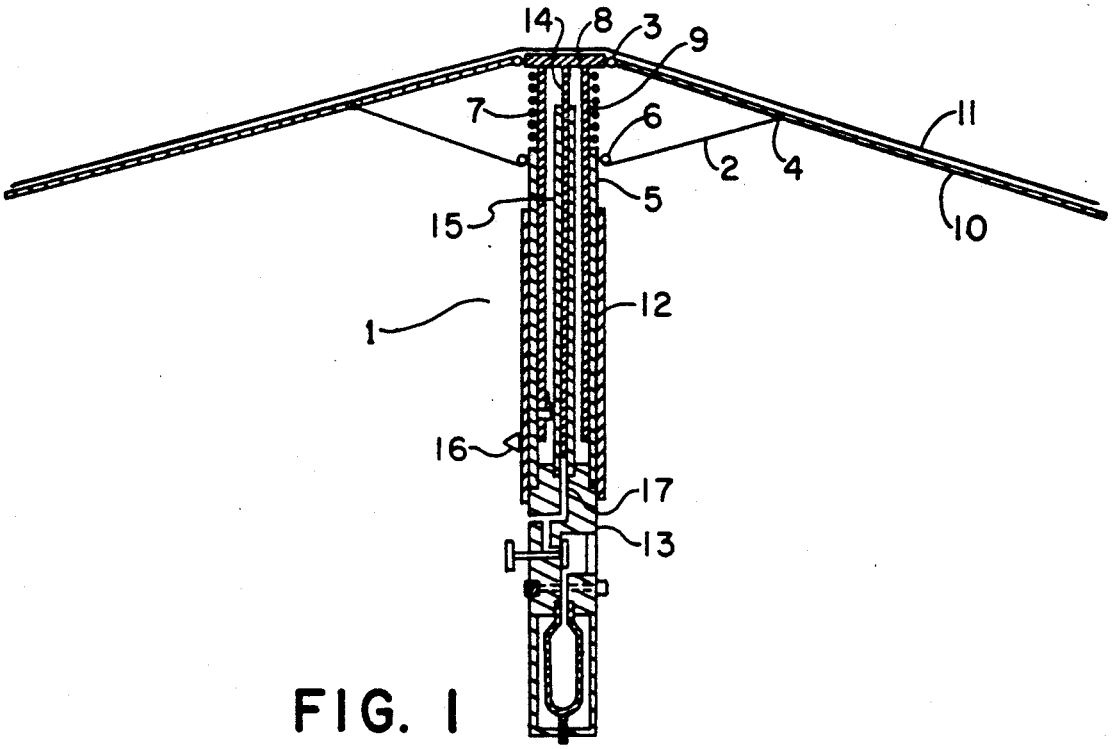
FIG. 1 contains a sectional view of the umbrella mechanism 1 wherein the umbrella is in an opened position.

Ribs 10 are covered by and attached to water repellent fabric 11. In addition strut 2 is attached to outermost cylinder 5 at pivot point 6.

Cylinder spring 7 is attached at one of its ends to outermost cylinder 5 and at its opposite end said cylinder spring 7 is attached to cylinder cap 8.

Cylinder cap 8 is itself attached to inner cylinder 9 which extends through the center of spring 7, and thence into outer cylinder 5 such that inner cylinder 9 is connected with outer cylinder 5.

Inner cylinder 9 is free to slide up and down within outer cylinder 5. Cylinder 5 is attached at its lower end to the handle 13. Tube 15 is concentrically located within inner cylinder 9 and attached at one end to handle 13. Shaft 14 fits snugly within tube 15 and is attached at one of its ends to cylinder cap 8. Outer sleeve 12 fits snugly around the outside perimeter of outer cylinder 5 and is free to move up and down in relation to outer cylinder 5 with the application of force to thumb piece 16. Axial passage 17, which is oriented along the major axis of handle 13, connects the hollow interior of tube 15 with radial passage 18. Radial passage 18, as shown in FIG. 1, connects axial passage 17 to the exterior of handle 13. Secondary passage 27 which is also located axially intersects radial passage 18 at a right angle, as shown in FIG. 1, such that secondary passage 27 provides a flow path for gases between radial passage 18 and chamber 26.

Figure 2:
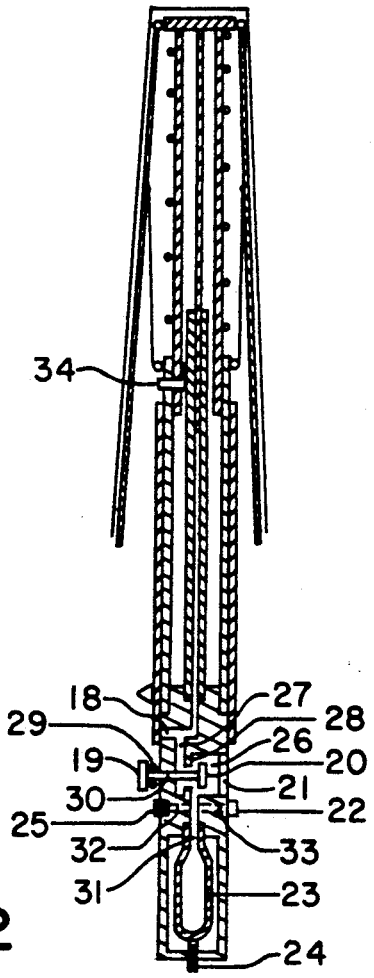
FIG. 2 contains a sectional view of the umbrella mechanism wherein the umbrella mechanism 1 is in a closed position.
Figure 1A:
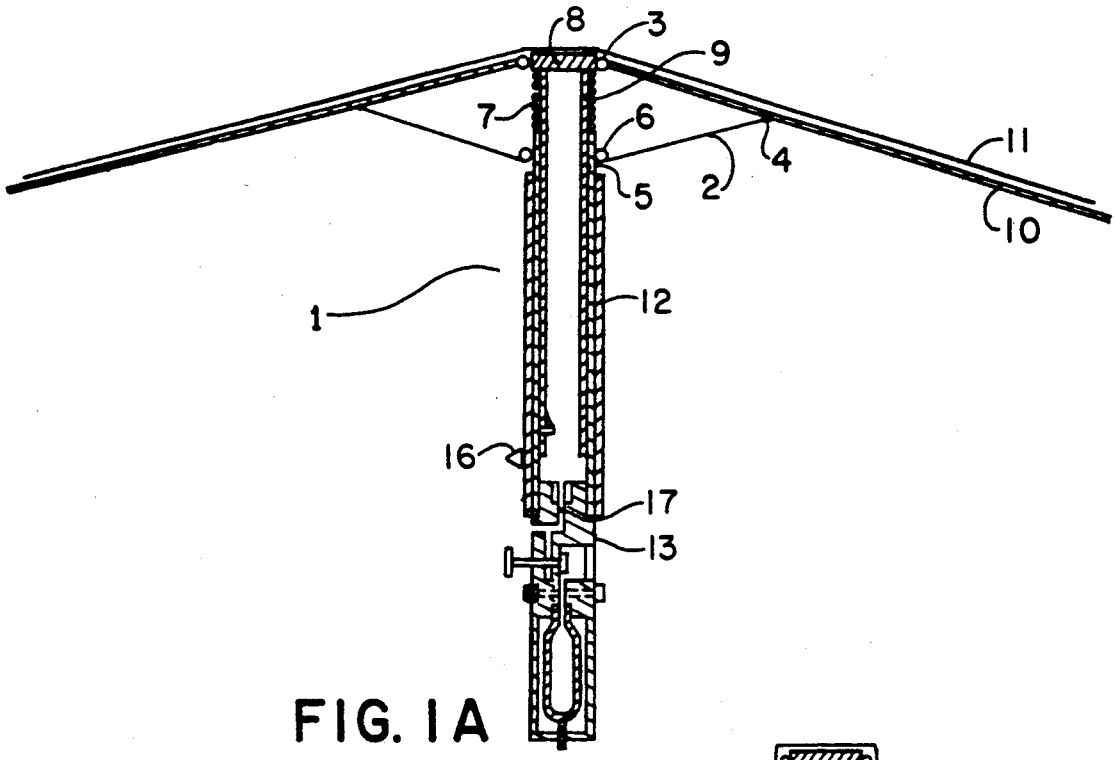
Figure 2A:
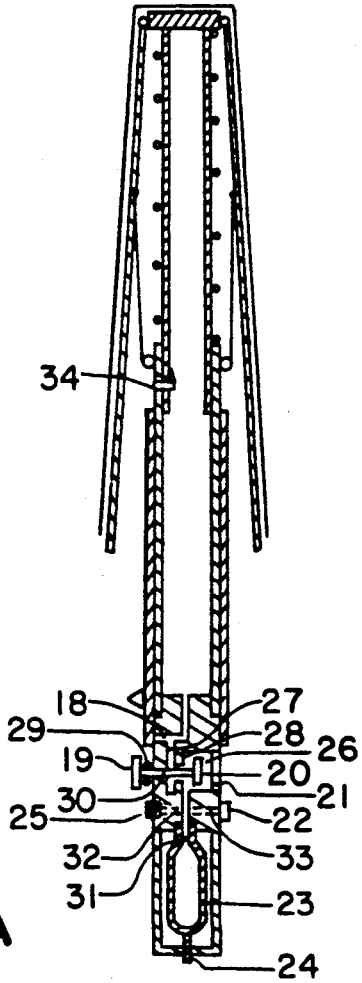

FIG. 2 shows how upon the depression of button 19 which compresses valve spring 29 the depression of button 19 through the action of valve shaft 30, to which button 19 is connected, causes valve plug 20 to move away from valve seal 28 and thereby allows a passage of pressurized gases contained in chamber 26 into secondary passage 27. Chamber 26 is sealed from the exterior of handle 13 by chamber plug 21 which may be removed to allow disassembly of valve plug 20 from valve shaft 30. Ampule passage 31 connects chamber 26 with ampule 23 wherein said ampule 23 contains gases such as air, nitrogen or carbon dioxide under pressure commonly between 137.9 and 689.4 kilopascals. Set screw 24 holds ampule 23 firmly against the opening of ampule passage 31 as shown in FIG. 1, to avoid the escape of gases. Needle valve 25 is similar in configuration to valves commonly used in automobile tires and tubes. Needle valve 25 is used to replenish the supply of gas in ampule 23 by means of needle valve passage 32 which intersects ampule passage 31. Pressure relief valve 22 which is connected to ampule passage 31 by pressure relief passage 33 may consist of any one of many designs known in the art capable of avoiding the creation of excess pressure within ampule 23 and chamber 26 during the replenishment of gas within ampule 23 through the use of needle valve 25.

FIG. 2 also shows how upon sliding sleeve 12 on outer cylinder 5 into a position such that it prevents the passage of gas through radial passage 18 to the exterior of handle 13 followed by the subsequent depression of button 19 pressurized gases flow through ampule 23 through ampule passage 31, chamber 26, secondary passage 27, radial passage 18, axial passage 17, and then into the interior of tube 15. The aforesaid gases force shaft 14 and consequently cylinder cap 8 and inner cylinder 9 upward. This upward movement of cylinder cap 8 causes ribs 10 to assume a position (commonly termed the closed position) substantially parallel to and adjacent to sleeve 12 by rotation of strut 2 around pivot point 4 and 6 simultaneous with the rotation of ribs 10 around pivot points 3 and 4 as depicted in FIG. 2. In this position as shown in FIG. 2 catch 34 attached to inner cylinder 9 engages an opening 35 in outer cylinder 5 and holds the umbrella device in the so-called closed position. Thus the closing of the umbrella device is accomplished merely by the depression of button 19.

Figure 3:
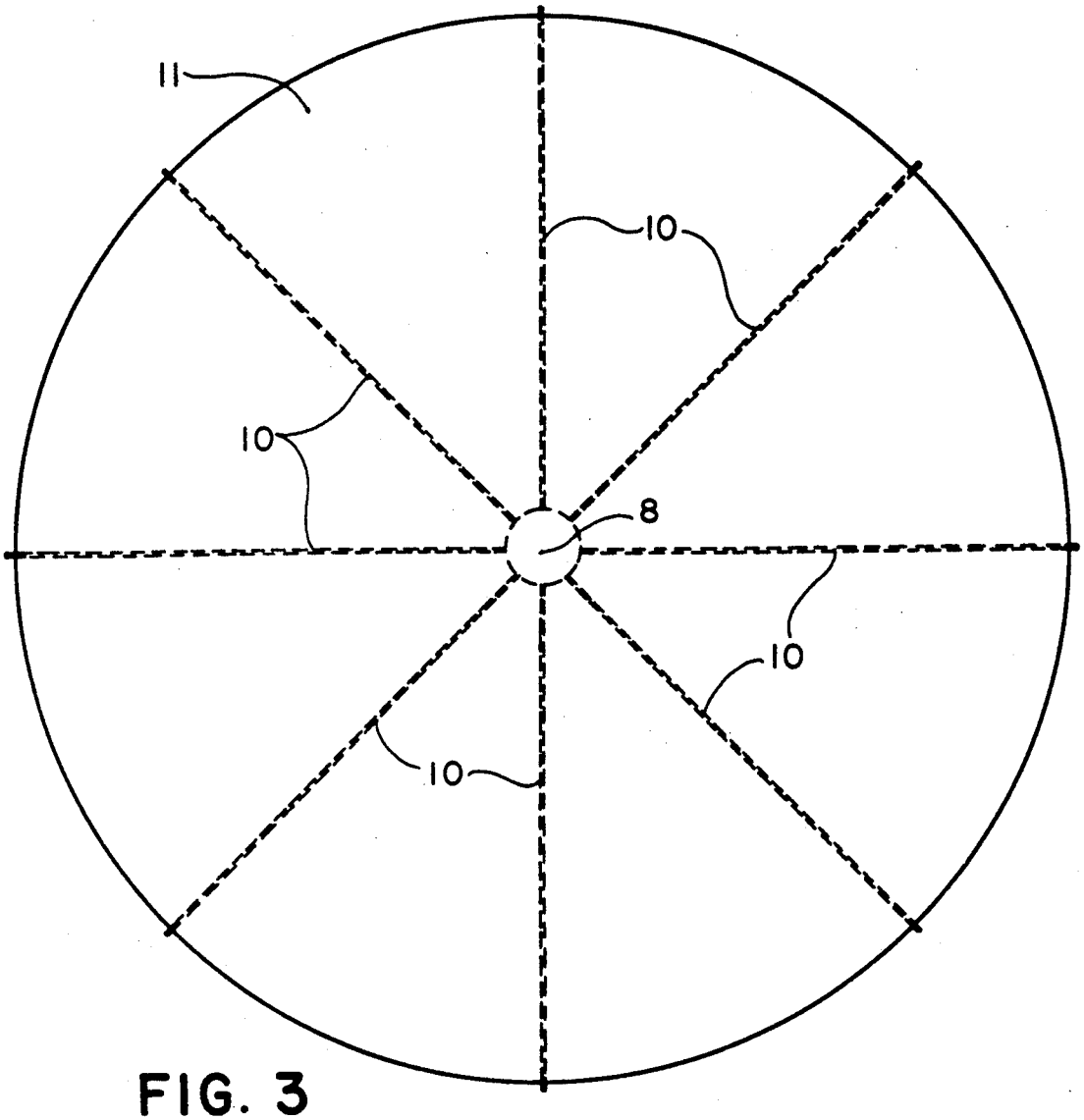
FIG. 3 contains an overhead view of the umbrella mechanism while in the open position depicted in cross section by FIG. 1.
Figure 4:
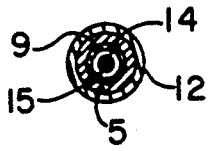
FIG. 4 contains a sectional view taken along lines A—A of FIG. 1.

The opening of the umbrella device is accomplished merely by applying upward pressure on thumb piece 16 which causes sleeve 12 to slide upward on outer cylinder 5 and thereby first opens radial passage 18 to the atmosphere (i.e. to the exterior of handle 13) and then with the continuing upward movement causes the release of catch 34 whereby the retracting action of cylinder spring 7 causes cylinder cap 8 along with shaft 14 in inner cylinder 9 to advance toward the uppermost end of outer cylinder 5 and ultimately assume the relative position shown in FIG. 1. During this opening of the umbrella device, button 19 is ideally not depressed; thereby conserving the supply of compressed gases contained in ampule 23 and chamber 26. This opened position depicted in cross section by FIG. 1 is further illustrated by the overhead view of the umbrella device shown in FIG. 3. FIG. 4, which is a cross section along lines A—A of FIG. 1, shows the concentric nature of sleeve 12, outermost cylinder 5, inner cylinder 9, tube 15 and shaft 14.

One variation in the structure of the umbrella device shown in FIGS. 1 through 4 eliminates inner cylinder 9 and outer cylinder 5 and simply requires that sleeve 12 fit snugly around tube 15. In this variation cylinder spring 7 is attached to the uppermost end of tube 15 as is pivot point 6 and thereby strut 2. Similarly catch 34 is located on shaft 14 and engages an opening in tube 15 in the closed position shown in FIG. 2 in a manner similar to that employed in the original embodiment of the present umbrella device which does contain inner cylinder 9 and outer cylinder 5. Be it known that this aforementioned variation of the original embodiment, depending on the choice of materials for shaft 14 and tube 15, can exhibit less strength than the original embodiment which is depicted in FIGS. 1 through 4. That is, the presence of inner cylinder 9 and outer cylinder 5 provides a means of increased strength through increased diameter without at the same time requiring larger amounts of gases due to an increase in volume associated with expanding the diameter of tube 15 and shaft 14. Similarly it can be seen that the umbrella device depicted in FIGS. 1 through 4 would also function with the elimination of shaft 14 and tube 15 but so configured the device modified by the exclusion of shaft 14 and tube 15 would require the release of much larger amounts of gas from ampule 23 in order to effect the closing of the umbrella device than the amount of gas required by the umbrella device as shown in FIGS. 1 through 4.

Figure 5:
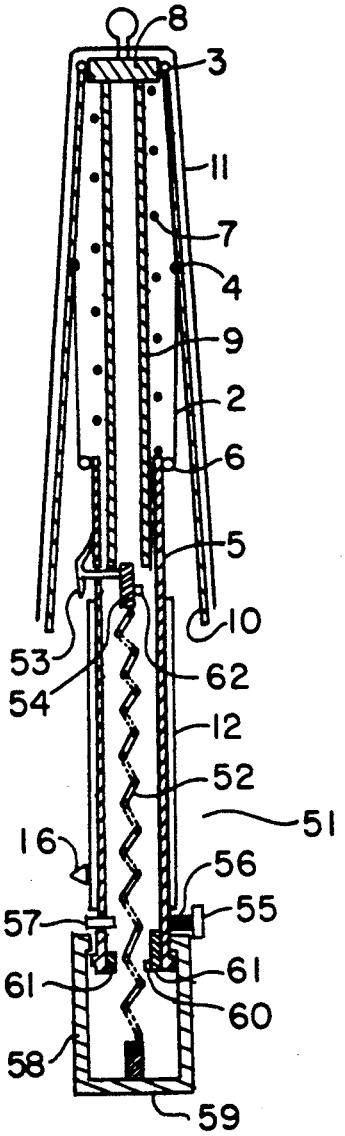

The umbrella 51 of FIG. 5 contains elements 2 through 12 which are similar to Items 2 through 12 of the umbrella 1 depicted in FIGS. 1 through 4. In addition there is shown in FIG. 5 certain modifications consisting of elements which are different when comparison is made between the umbrella 1 of the first type and the aforesaid umbrella 51 of the second type. In FIG. 5 closing spring 52 is a helical coil which is attached at its lower end to spring base 59 and at its upper end to spring latch 54. Spring base 59 is in turn attached to the handle 58 wherein handle 58 screws onto the threaded lower end of outermost cylinder 5. (It is to be understood that the expansive force exerted by closing spring 52 is greater than the contractile force exerted by cylinder spring 7). Also as shown in FIG. 5 there is attached to the inner surface of outermost cylinder 5 an inner sleeve 61. Stationary catch 60 is attached to inner sleeve 61 is shown in FIG. 5. Also as shown in FIG. 5 upper stop 53 is attached to outermost cylinder 5 such that a portion of it protrudes through a hole in outermost cylinder 5 and holds inner cylinder 9 in the elevated position shown in FIG. 5 against the force exerted by cylinder spring 7. Upper stop 53 is composed of spring steel or other such material such that the application of upward force on thumb piece 16 causes sleeve 12 to slide upward on outer cylinder 5, and sleeve 12 is thereby forced between the lower projection of upper stop 53 and outermost cylinder 5, upper stop 53 is thereby forced radially outward from the major vertical axis of the umbrella releasing inner cylinder 9 which through the contractile force of cylinder spring 7 is forced down within outermost cylinder 5 to a position shown in FIG. 9. Lower stop 57 is moved inward and outward relative to the major vertical axis of the umbrella through the application of force to pushbutton 55 which depresses pushbutton spring 56. The connection of lower stop 57 to pushbutton 55 is accomplished as shown in FIG. 10. Radial catch 62 protrudes radially from spring latch 54, and vertical catch 63 protrudes vertically upward from spring latch 54 in the "released" position depicted in FIG. 5. This "released" position is shown in detail in FIG. 11. As shown in FIG. 11 vertical catch 63 and radial catch 62 are, in reality, perpendicularly projecting surfaces of the same catch element 64 wherein this catch element 64 is held in a slot in spring latch 54 by spring latch pin 70, such that latch element 64 rotates about spring latch pin 70. Bullet pin 71 protrudes up into either one of two notches in the bottom surface of latch element 64. Bullet pin 71 is forced up into either of the aforesaid two notches in latch element 64 by the action of bullet spring 72. As shown in FIG. 11 when bullet pin 71 is in the rightmost notch of the aforesaid two notches of the latch element 64, latch element 64 is held in the aforesaid released position. However, when radial catch 62 is forced upward by contact with stationary catch 60, as shown in FIG. 12, bullet pin 71 is forced downward—compressing bullet spring 72—and latch element 64 rotates about spring latch pin 70. Following the aforesaid rotation of latch element 64, bullet pin 71 rests in the leftmost notch of the aforesaid two notches in the bottom surface of latch element 64 as shown in FIG. 12, wherein the position of latch element 64 shown in FIG. 12 is termed the latched position. In this latched position vertical catch 63 contacts lower stop 67 upon the application of force in the upward direction to spring latch 54—as by the compression of closing spring 52.

The operation of the aforesaid umbrella 51 of the second type can be illustrated by reference to FIGS. 5 through 12. In FIG. 5 the aforesaid umbrella 51 is shown in the so-called closed position in which the aforesaid umbrella 51 is normally held before going out into the rain. Prior to entering the rain, handle 58 is unscrewed from the threaded lower position of outer cylinder 5 and spring 52 along with the attached spring latch 54 is withdrawn from the interior of outer cylinder 5 to a position shown in FIG. 6 such that spring latch 54, vertical catch 63, and radial catch 62 have assumed the relative position shown in detail in FIG. 12.

Figure 7:
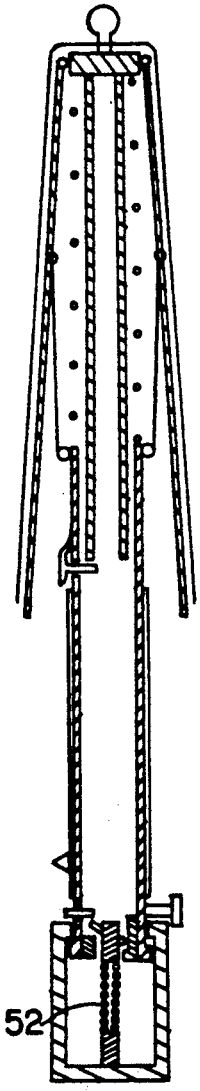

Force is then applied upward on handle 58 which compresses closing spring 52. Upon the threadable securement of handle 58 to the threaded lower portion of outer cylinder 5, the relative position of spring latch 54 and the closed spring 52 are as shown in FIG. 7. With this sequence of actions necessary preparations have been made for the automatic closing of the umbrella 51 once it has been opened.

The automatic opening of the umbrella 51 is accomplished by the application of upward pressure on thumb piece 16 which causes sleeve 12 to slide upward on outer cylinder 5 until it wedges between the lowermost projeftion of outer stop 53 and outermost cylinder 5 thus forcing upper stop 53 in a radial direction away from the major vertical axis of the umbrella, which allows inner cylinder 9 to travel downward within outer cylinder 5 to the position shown in FIG. 8. This movement of inner cylinder 9 downward as a result of the contractile force of cylinder spring 7 is accompanied obviously by rotation of strut 2 about pivot paint 6 and pivot point 4 while umbrella ribs 10 rotate around pivot point 3 to accomplish the so called open position of the umbrella shown in the aforesaid FIG. 8.

The automatic closing of the umbrella with only one hand is accomplished merely by depressing pushbuttom 55 which in turn compresses spring 56 and moves lower stop 57 in a radial direction outward such that spring latch 54 and vertical catch 63 are free to move upward and do so as a result of the compressive force of closed spring 52, such that vertical catch 63 engages at lower end of inner cylinder 9 and drives it upward to the relative position shown in FIG. 5. In the process of this upward movement of spring latch 54 and inner cylinder 9, as vertical catch 63 passes the position of upper stop 53, the axially projecting portion of upper stop 53 presses against vertical catch 63 with sufficient force to cause the rotation of latch element 64 about spring latch pin 70 such that the aforesaid "released" position is attainable by latch element 64 as depicted in FIG. 11. The full cycle of operation of the umbrella 51 in the automatic mode has thus been described.

Manual operation of the aforesaid umbrella can also be accomplished from the so called closed position shown in FIG. 5 merely by the application of upward pressure on thumb piece 16 which causes sleeve 12 to slide upward on outer cylinder 5. As sleeve 12 is forced between upper stop 53 and outer cylinder 5 inner cylinder 9 is forced downward by the contractile force of cylinder spring 7 to the position shown in FIG. 9. The manual closing of the umbrella 51 is accomplished merely by grasping handle 58 in one hand and grasping pull ring 73 in the other. Force is then applied to separate the two hands which causes inner cylinder 9 to slide upward and thereby ultimately assume the position shown in FIG. 5.

Figure 13A:
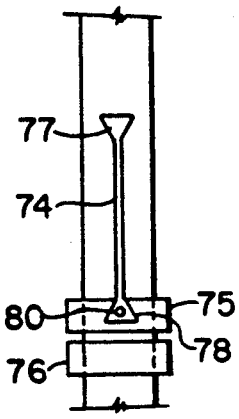
FIG. 13A is a side view of FIG. 13 showing a detail of the aforementioned modifications.
Figure 13:
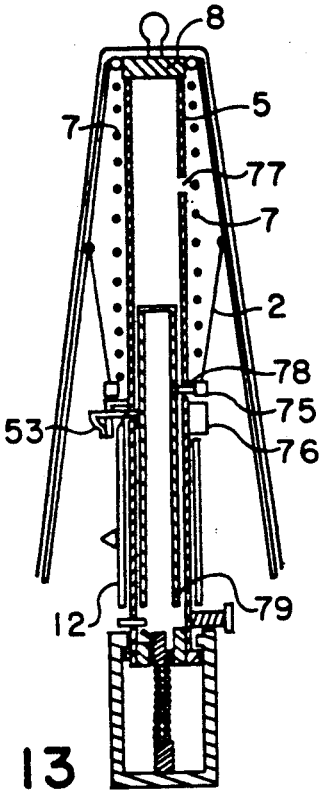
FIG. 13 is a sectional view of the embodiment shown in FIG. 5 wherein modifications reverse the roles of closing spring 5 and cylinder spring 7.

As previously indicated FIG. 13 depicts the embodiment of FIG. 5 wherein modifications have been made which reverse the function of cylinder spring 7 and closing spring 52. That is in the embodiment shown in FIG. 13 closing spring 52 provides the motive force to open the umbrella rather than close it and cylinder spring 7 provides the force to close the umbrella. To achieve this end the cylinder spring 7 shown in FIG. 13 differs from the cylinder spring shown in FIG. 5 in that the cylinder spring of FIG. 5 requires the exertion of force to expand it while the cylinder spring of FIG. 13 requires the exertion of force to compress it.

Figure 13B:
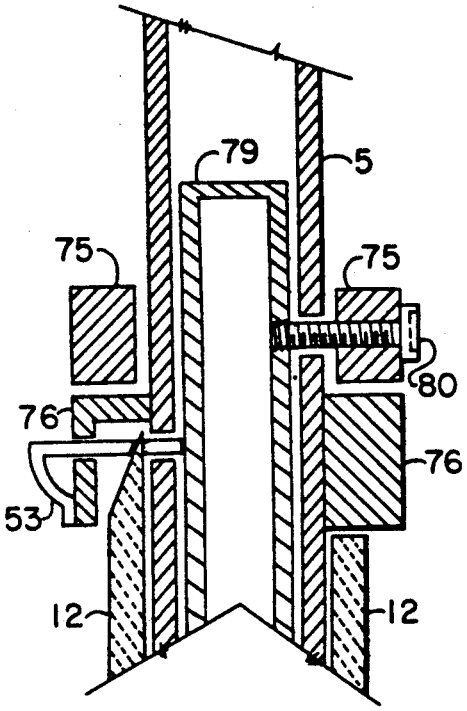
FIG. 13B is an enlarged sectional view of a portion of FIG. 13 showing in greater detail how the aforesaid modifications interact to effect the opening and closing of the umbrella embodiment of FIG. 13.

Further it can be seen that inner cylinder 9 of FIG. 5 has been detached from cylinder cap 8 to form internal rod 79 of FIG. 13. In addition, outer cylinder 5 of FIG. 5 has been attached to cylinder cap 8 in FIG. 13. Also in FIG. 13 struts 2 are attached to and rotate within collar 75 rather than being attached to outermost cylinder 5 at a pivot point 6 as in FIG. 5. Collar 75 is attached by means of collar pin 80 to internal rod 79, wherein collar pin 80 extends from collar 75 through slot 74 to internal rod 79 as shown in FIGS. 13A and 13B. For purposes of illustration, slot 74 has been shown to have a triangularly shaped slot end 77 at its upper end and a triangularly shaped slot end 78 at its lower end. FIG. 13 is a sectional view taken along lines 13—13 of FIG. 13A. Thus upper slot end 77 and lower slot end 78 are shown in FIG. 13 as short breaks in the wall of outermost cylinder 5.

Figure 14:
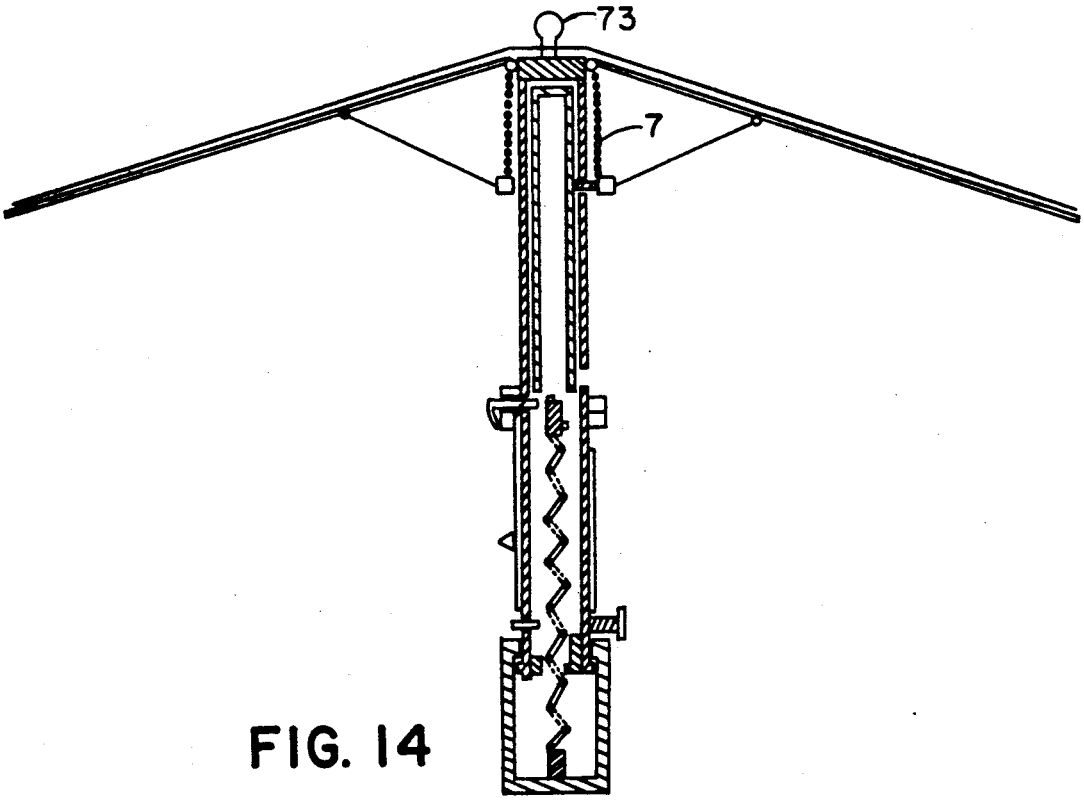
FIG. 14 illustrates the umbrella embodiment of FIG. 13 after it has been "opened".

Collar stop 76 merely provides a convenient attachment point for upper stop 53 which is fabricated from spring steel. As shown in FIG. 13B upward force on outer sleeve 12 would cause upward motion of outer sleeve 12 and force upper stop 53 radially outward from its normal position to the position shown in FIG. 13B. This allows internal rod 79 to move downward from its position shown in FIG. 14 where the umbrella is open, to its position shown in FIGS. 13, 13A, and 13B where the umbrella is closed. The internal rod 79 is forced to move downward by the action of cylinder spring 7 on collar 75 which is in turn attached to internal rod 79 by collar pin 80. Thus the umbrella is made to attain the closed position.

Figure 6:
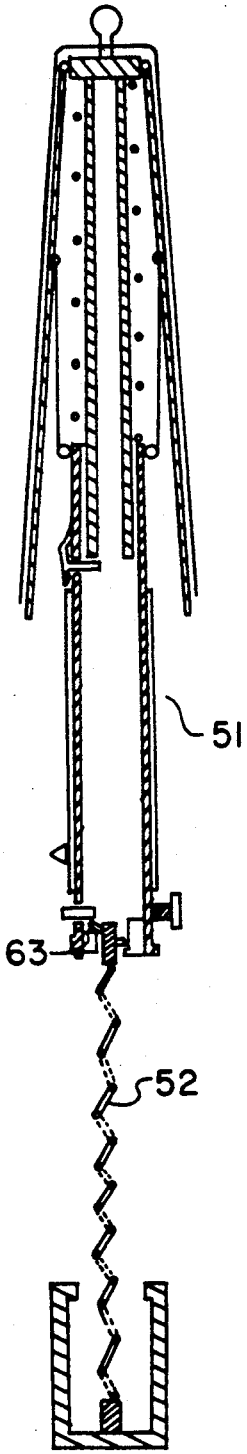

To effect the automatic opening of the umbrella, handle 58 is first disengaged or unscrewed from outer cylinder 5 and the spring 52 compressed as previously described in connection with FIGS. 5 and 6. The subsequent depression of pushbutton 55 forces inner cylinder 9 to travel upward which in turn causes collar 75 to move upward relative to outer cylinder 5 which forces struts 2 outward thereby opening the umbrella.

Figure 15:
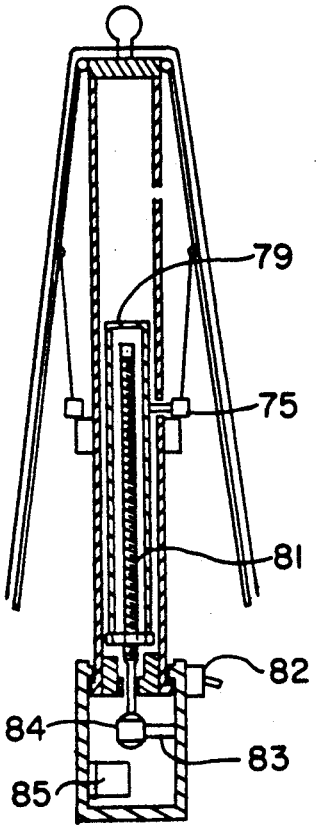
FIG. 15 illustrates in the closed position an embodiment wherein a small electric motor may be used to open and close the umbrella of FIG. 13 rather than springs.
Figure 16:
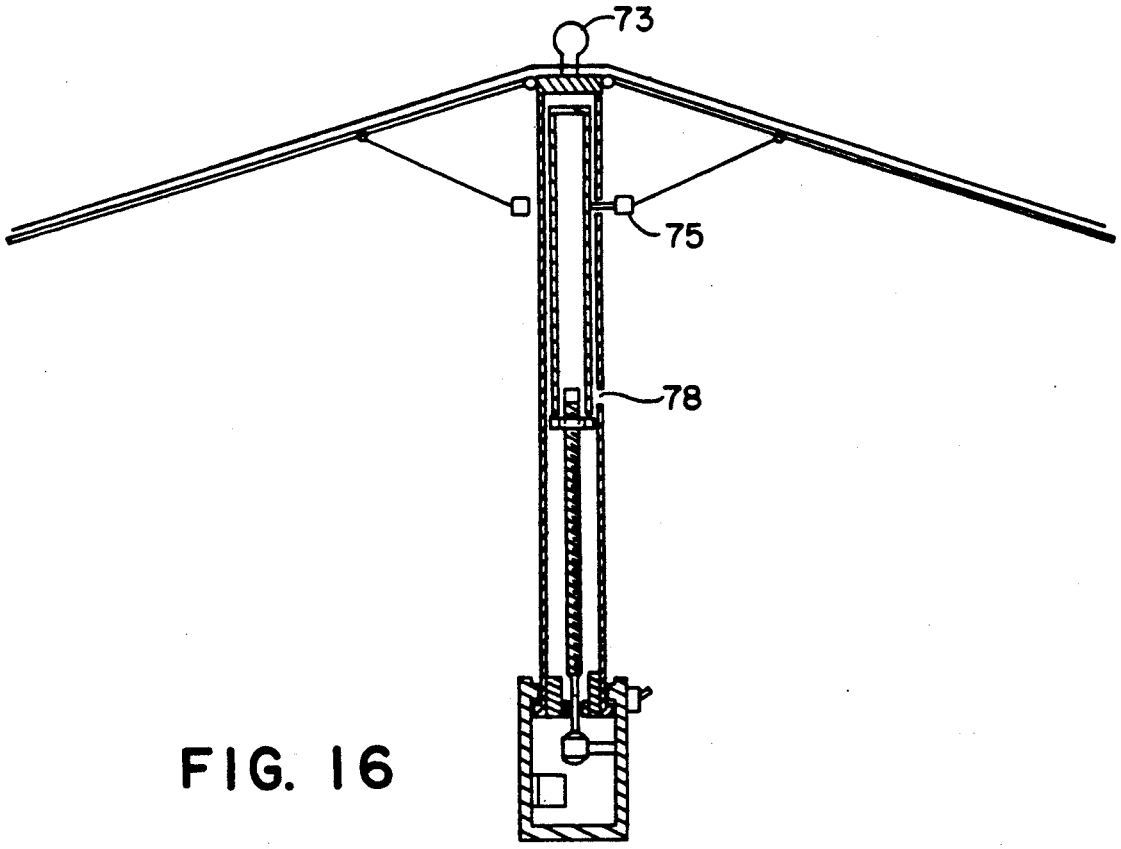
FIG. 16 illustrates the opened position of the embodiment of FIG. 15.

FIG. 15 depicts an embodiment in which the opening and closing of the umbrella is accomplished also by the upward and downward movement of inner cylinder 9. However, in the embodiment of FIG. 15 a threaded nut 86 has been attached to the lower end of inner cylinder 9 such that when internal screw 81 is threadably inserted and rotated the threaded nut 86 and consequently the inner cylinder 9 move upward and downward. The rotating shaft of bidirectional motor 84 is attached to the lower end of internal screw 81. The casing of the electric motor 84 is attached by means of motor support 83 to the handle 58. By means of electric circuitry commonly known in the art of electronics the potential energy stored in battery 85 can be used to effect, with the movement of position switch 82 to one of its available positions, the shaft of the electric motor 84 to roatate in a given direction causing the upward or downward motion of threaded nut 86. Movement of the position switch 82 to yet another position can be made to effect the rotation in the opposite direction of the shaft of electric motor 84. This of course causes movement of threaded nut 86 and consequently of inner cylinder 9 in a direction opposite to that previously induced. In this manner the umbrella can be made to open and close automatically, where the open position of the umbrella is shown in FIG. 16 and the closed position is shown in FIG. 15.

Figure 17:
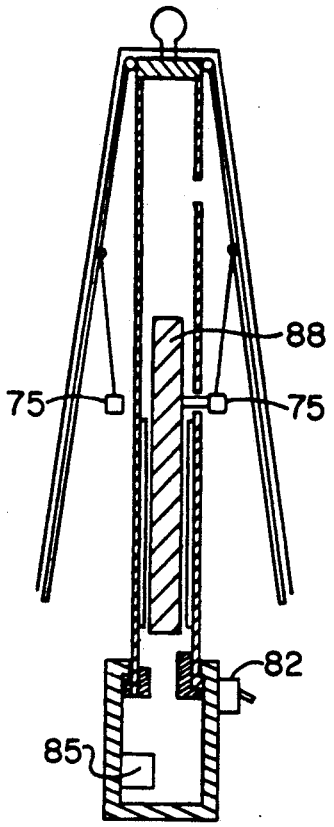
FIG. 17 illustrates in the closed position an embodiment in which the motive force used to open and close the umbrella is provided by a magnet and solenoid.
Figure 18:
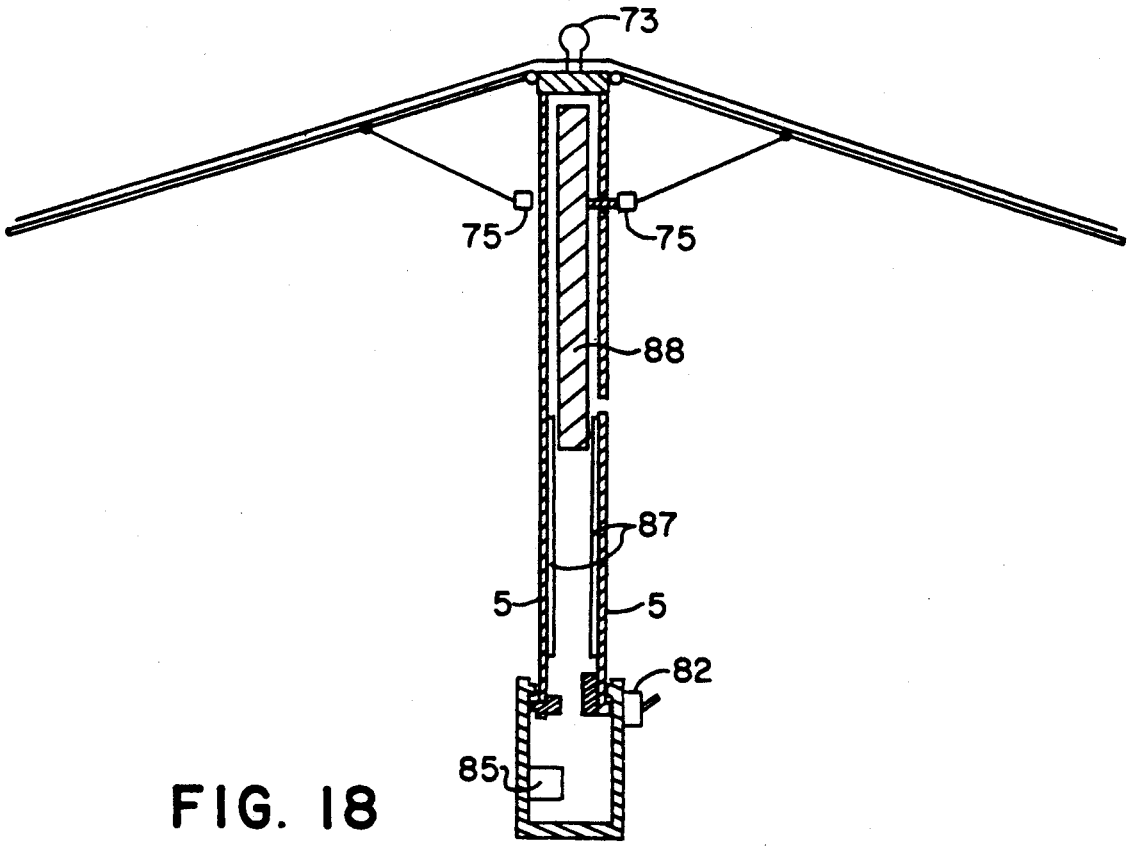
FIG. 18 illustrates the embodiment of FIG. 17 in the open position.

In the embodiment shown in FIGS. 17 and 18 the motive force required for moving collar 75 upward and downward is provided by means of a magnet 88 contained within the center of solenoid 87. By means known in the art of physics the flow of electricity through wires wound within the solenoid can be effected using the battery 85 as a source of electric potential so that the induced electric field exerts an upward force on the magnet 88 which effects the closing of the umbrella as shown in FIG. 18. Also by means commonly known in the art of electrical circuits the direction of the flow of electricity in solenoid 87 can be reversed through altering the position of switch 82 so that downward force is now exerted on magnet 88 and hence on collar 75 which is connected to magnet 88 by collar pin 80. The embodiment shown in FIG. 19 in closed position in a sectional view is similar to the embodiment previously described in connection with FIG. 1 as reflected in the occurrence of identically numbered items.

Figure 19:
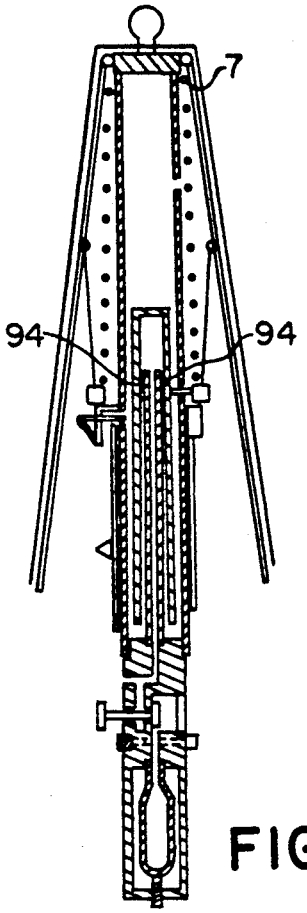
FIG. 19 is a sectional view of an embodiment in which compressed gas provides the motive force to open and close the embodiment which is depicted in the closed position.
Figure 19A:
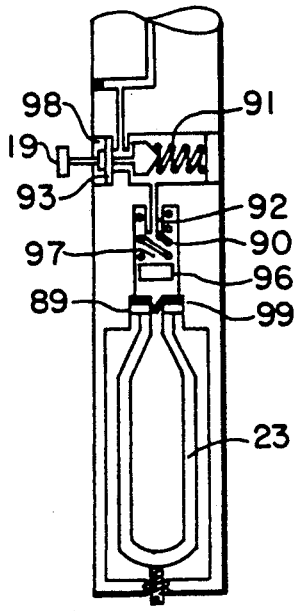
FIG. 19A illustrates an enlarged sectional of a mechanism used to control the flow of gas.
Figure 19B:
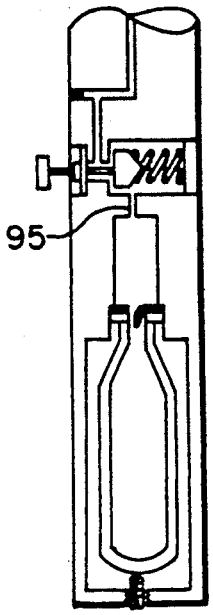
FIG. 19B illustrates in enlarged sectional view an alternative means of controlling the flow of gas.
Figure 20:
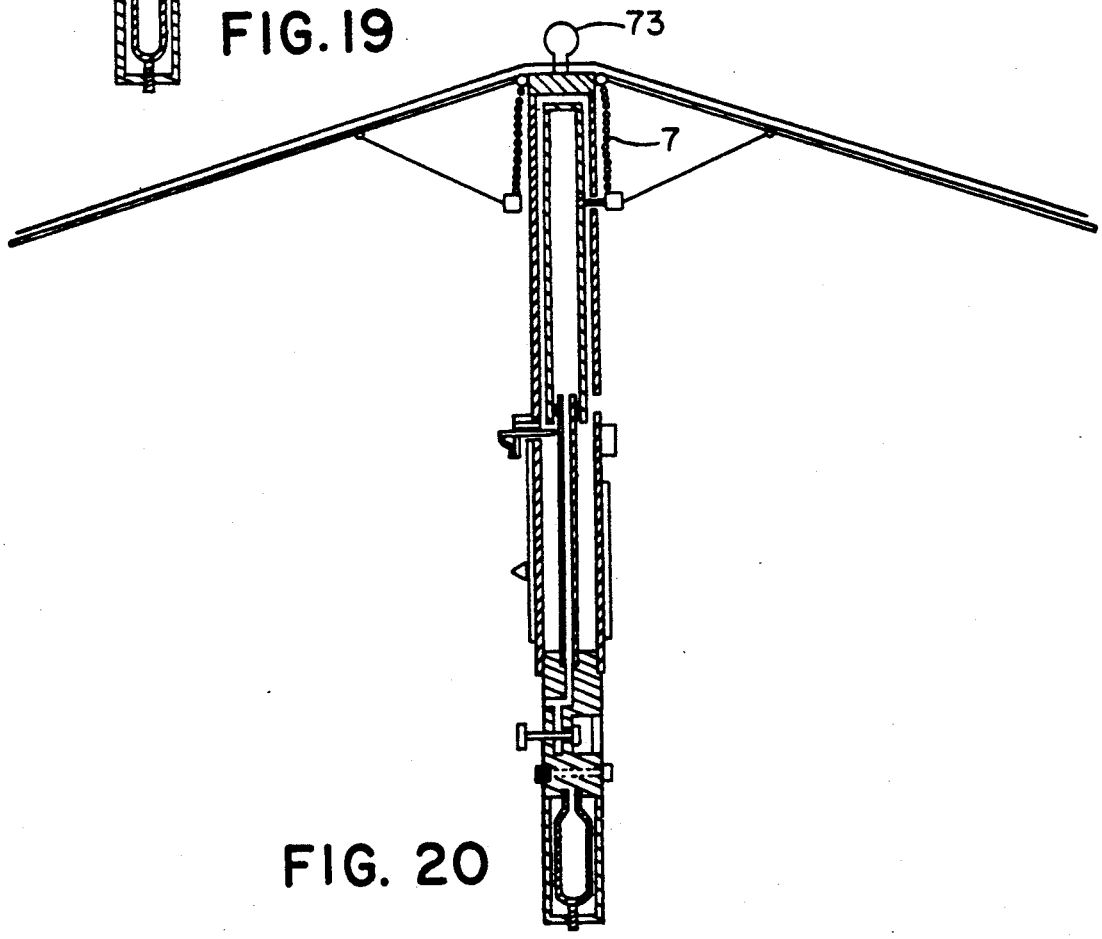
FIG. 20 shows in the open position the embodiment of FIG. 19.

However, in the embodiment of FIG. 19 inner cylinder 9 has been detached from cylinder cap 8 and outer cylinder 5 has been in turn attached to cylinder cap 8. The other modifications pertaining to the installation of slot 74, collar 75, collar stop 76, upper stop 53, collar pin 80, internal rod 79 and cylinder spring 7 have also been made. In addition, an "o" ring 94 has been attached to the upper end of tube 15 so that a seal is formed between inner cylinder 9 and the tube 15 such that when button 19 is depressed as previously described in connection with FIG. 1, the gas which enters the space encompassed by tube 15 and inner cylinder 9 acts to force inner cylinder 9 upward; thereby opening the umbrella to the position shown in FIG. 20. The inner cylinder is secured in the up position by the insertion of upper stop 53 in the manner previously described in connection with FIG. 1. It has been found in the development of this embodiment that when ampule 23 is provided with a gas of sufficiently high pressure that the button 19 shown in FIGS. 1 and 19 cannot be easily depressed and released fast enough to avoid overpressuring the area within tube 15 and inner cylinder 9 to a pressure beyond that required to open the umbrella. This resulted in the unnecessary loss of gas from the ampule 23 with each opening of the umbrella and decreased therefore the number of times the umbrella could be opened without refilling the ampule 23 or providing a new ampule 23 filled with gas. It has been found possible to avoid this overpressuring by two different methods. The first of these methods is illustrated in FIG. 19A while the second is illustrated in FIG. 19B. The operation of the mechanism of FIG. 19A can be explained as follows. When the button 19 is depressed the pressure within chamber 26 drops very rapidly and hence the pressure on the upward side of disc 96 in disc chamber 97 also drops very rapidly. Since the pressure on the down side of the disc 96 is still higher owing to the inability of the gas to get past the small wall clearance between disc 96 and the wall of the chamber 97, an unbalanced force moves the disc 96 upward against the action of surge spring 90 until the disc 96 comes into contact with the surge seat 92. As this seat is made, very little or no further gas escapes from the ampule 23 even if the depression of button 19 is continued.

However, after button 19 is released as gas slowly filters between the wall of chamber 97 and disc 96 the pressure on the upstream and downstream sides of disc 96 is partially equalized. This partial equalization coupled with the force of surge spring 90 causes the disc 96 to move downward to its former position before button 19 was depressed. In this way the flow of gas from ampule can be regulated in "shots". The shot size can be varied by varying the volume of chamber 26 and chamber 97.

An alternative means of regulating this flow of gas from ampule 23 can be found in FIG. 19B wherein it is shown that an extremely small diameter orifice can be used to restrict the flow gas so severely that when the limiting condition of gas reaching the speed of sound in the orifice is reached the total gas flow during 2 or three seconds in which button 19 is depressed is within the range required merely to open the umbrella and not cause overpressuring. The size of this orifice depends upon the pressure of the gas contained in the ampule 23. However, for cases where ampule 23 is initially at pressures in the range of 4136 kilopascals to 8273 kilopascals as is the case for supercritical or highly compressed gases the diameter of orifice has been found to be satisfactory when it is in the range of 0.127 to 1.016 millimeters in diameter.

A further improvement is displayed in the FIGS. 19A and 19B in that it will be noticed that the valve plug 20 of these figures is conical in shape when viewed from the high pressure side of the plug. This conical shape has been found to decrease the amount of pressure required on button 19 in order to open valve plug 20 when extremely high pressures are used in ampule 23. In addition, improvement has been achieved by increasing the number of openings and closings obtainable with one ampule by the addition of a diaphragm 93, which is flexible, as an interruption in the valve shaft 30 of FIG. 1 to form the arrangment shown in FIGS. 19A and 19B. Diaphragm retainer 98 holds both the diaphragm 93 and the outer end of valve shaft 30 in place, wherein the widened portion of the valve shaft 30 fits into a suitably widened area in the diaphragm retainer 98. As an added advantage, the provision of a conical seal puncture 99 as shown in FIGS. 19A and 19B allows the use of disposable cartridges of carbon dioxide which contain a metal plate which is punctured by seal puncture 99 upon the application of pressure by set screw 24 to the bottom of the ampule 23.

Figure 21:
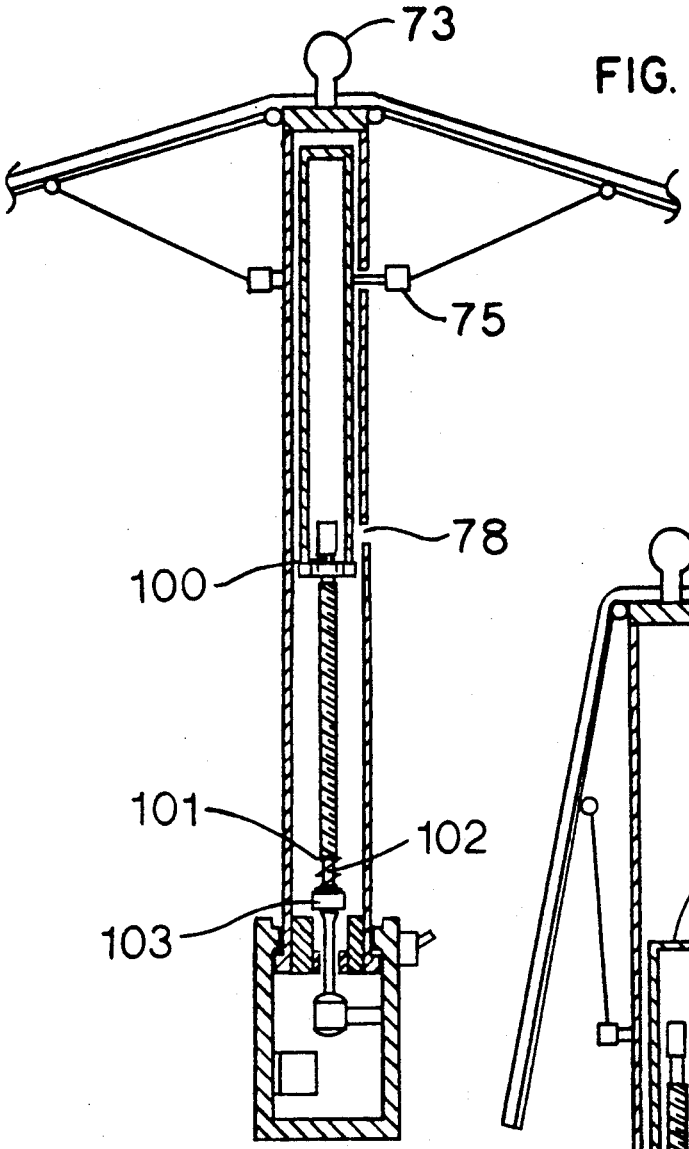
FIG. 21 shows in open position an improved version of the embodiment shown in FIG. 15 whereby a smooth area is provided on the threaded rod 81 to limit the torque and power required by the motor 84.

FIG. 21 shows an improvement to the embodiment displayed in FIG. 15 wherein the threaded rod 81 has undergone modification. As part of these modifications, an area of reduced diameter, 100, has been formed on the rod 81 on its uppermost end, wherein this area of reduced diameter is devoid of threads so that even though rod 81 is rotated the threaded nut 86 will not be urged further upward beyond the area 100. The function of this uppermost area of reduced diameter is to allow "unloading" of the motor 84, when the threaded nut 86 reaches it s uppermost position upon opening of the umbrella. It has been found that this improvement does not prematurely discharge the batteries 85 and allows the use of a lower torque rating on the motor 84, and at the same time extends the life of the motor 84. However, this improvemen still allows the threaded nut 86 to progress downward on the threaded rod 81 to its lowermost end to close the umbrella when the direction of rotation of the motor 84 is reversed to reversing the direction of rotation of the threaded rod from the direction of rotation of the rod 81 used to open the umbrella.

There may be additionally provided at the lowermost end of the rod 81 a lowermost area of reduced diameter 101 of the rod 81 which is likewise not provided with threads but smooth in circumference. This lowermost area of reduced diameter 101, serves a a functions similar to those provided by the uppermost area of reduced diameter 100 with similar benefits.

Figure 22:
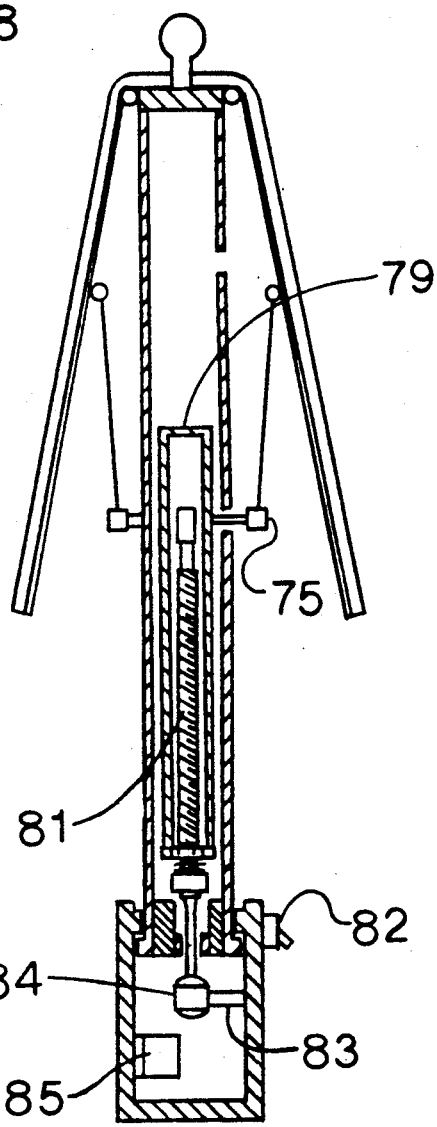
FIG. 22 shows in closed position the embodiment of FIG. 21.
Figure 23:
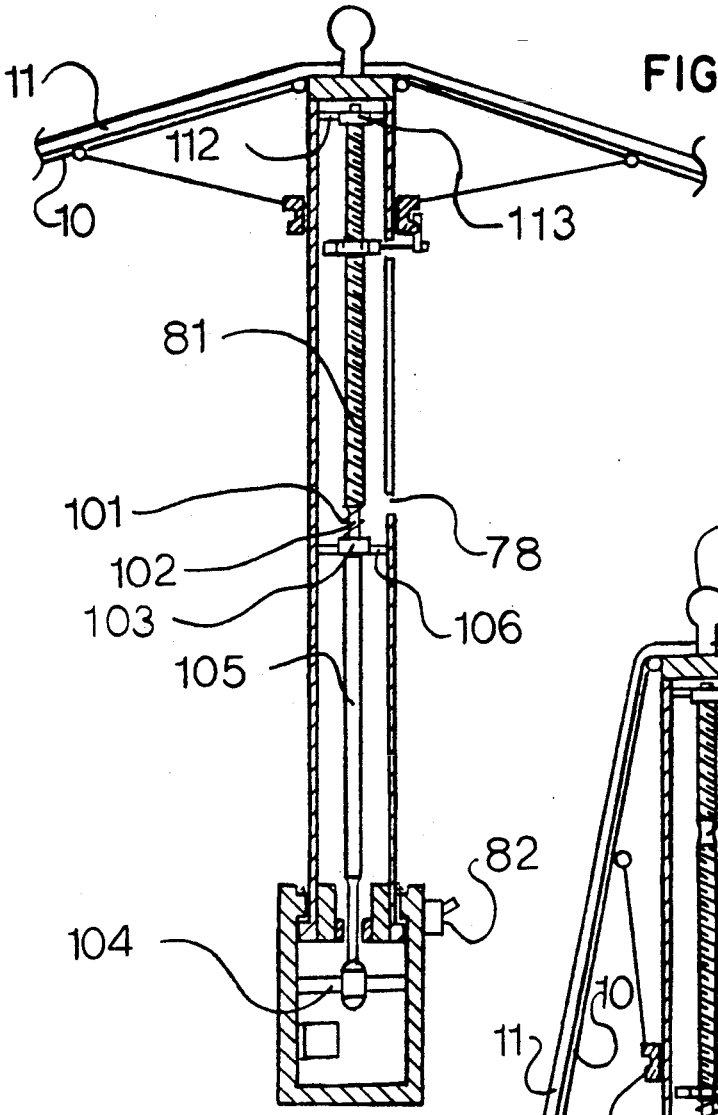
FIG. 23 shows in open position an improved version of the embodiment shown in FIG. 21 whereby inner cylinder 9 has been replaced by threaded cylinder 89.
Figure 24:
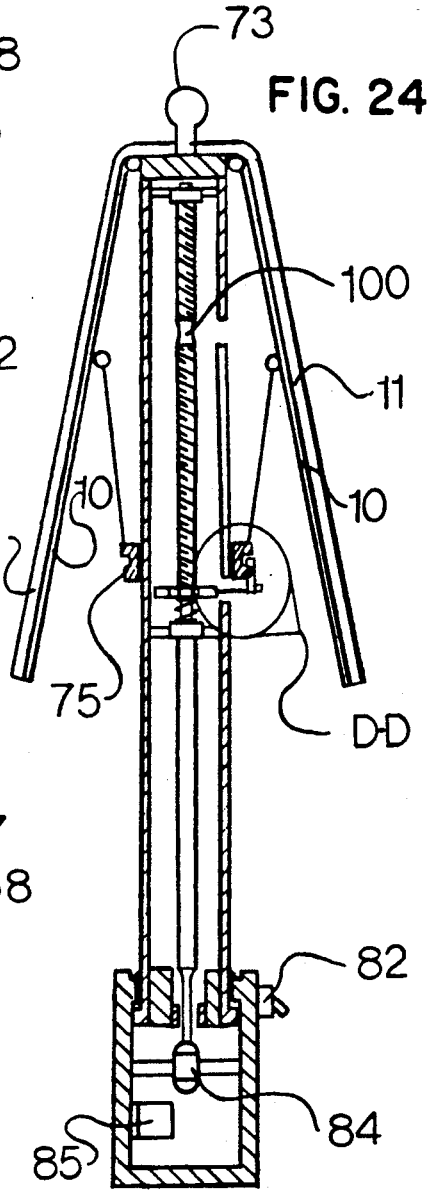
FIG. 24 shows in closed position the embodiment shown in FIG. 23.

The spring 102 shown in FIGS. 21 and 22 as attached at its lowermost end to a stationary positioner 103 which is in turn fixed in its relative axial position on the rod 81 has been shown to aid in the restarting of the threaded nut 86 on the threaded portion of rod 81 when the threaded nut 86 is starting from the lowermost area of reduced diameter 101. Obviously, spring 102 could be directly attached also to the threaded rod 81. The spring 102 is situated so that it is compressed upon movement of the threaded nut 86 onto the lowermost area of reduced diameter 101 and is of sufficient force to keep threaded nut 86 urged upward toward the threaded portion of rod 81 and hence allows smooth restarting of the threaded nut 86 on the threaded rod 81 when the motor 84 is actuated in the direction The rod 81 turns freely by virtue of the upper most bearing 113 and lower stationary positioner 103. Drive shaft 105, transfers motive power from motor 84 to rod 81, while reinforced motor support 104 insures adequate support of motor 84.

Figure 25:
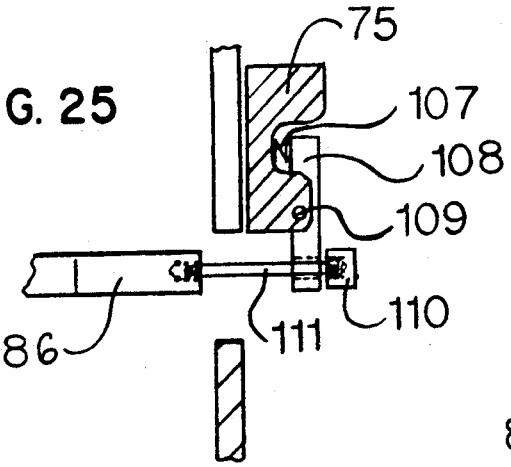
FIG. 25 is an enlarged view of the circled area of FIG. 24.

FIG. 25 shows in detail how an apparatus consisting of shaft 111, thumbpiece 110, arm 108, pin 109 and spring 107 can be fitted to collar 75. Since shaft 111, threadably inserts into threaded nut 86, when the battery 85 expires, it can be unscrewed from the threaded nut 86, and the collar 75 acuated manually to open and close the umbrella. Shaft 111 once so unscrewed from threaded nut 86, can be inserted in properly placed holes (not shown) to secure the umbrella in either the open or the closed position. Thus, the umbrella can still be used temporarily even if the battery runs out while it is raining.

Finally, it has been found more or less essential to the smooth operation of the umbrella that the threaded rod, 81, be fabricated such that there at least two separate parallel threads which run along its length. The threaded nut, 86, must likewise be fitted with matching parallel threads, of course. These parrallel threads are sometimes referred to as multiple leads. The use of multiple leads serves to, by some mechanism, keep the threaded nut, 86, from binding and becoming "cross-threaded" when trying to restart its travel on the threaded rod, 81, from the areas of reduced diameter, 100, or 101, at the uppermost and lowermost ends, respectively, of the threaded rod, 81.

While I have thus described the preferred embodiment of the present invention, many variations will be apparent to those skilled in the art and it must be understood that the foregoing description is intended to be illustrative only and not limitative of the present invention. All such variations and modifications as are in accord with the principles described are meant to fall within the scope of the appended claims.

I claim:

1. An umbrella having a canopy and a frame of interconnected ribs and a means for the automatic opening and closing of the aforesaid ribs and canopy comprising:

a hollow outer cylinder provided with a slot or slots extending therethru along a portion of its length;

a collar which slides along the exterior surface of the aforesaid hollow outer cylinder;

a threaded nut located concentrically within the aforesaid hollow outer cylinder and the said threaded nut is attached to the aforesaid collar by means of a pin or pins extending through the slot or slots provided in the aforesaid hollow outer cylinder;

an internal screw threadably inserted at one of its ends into the aforesaid the threaded nut;

an electric motor having a driveshaft said motor being fixed relative to the aforesaid hollow outer cylinder said driveshaft being attached to said internal screw, a battery which provides electromotive energy for the aforesaid electric motor;

wherein, further, there is a provided a switch which in a first position regulates flow of electricity from the aforesaid battery such that the shaft of the aforesaid electric motor turns in a first direction which, in turn, rotates the aforesaid internal screw, thereby moving the aforesaid threaded nut in a direction which forces the aforesaid canopy and ribs from the closed position to an open position;

wherein, placement of the said switch in a second position regulates the flow of electricity from the aforesaid battery such the shaft of the aforesaid electric motor turns in a second direction opposite to the said first direction which, in turn, rotates the aforesaid internal screw thereby moving the aforesaid threaded nut a in direction which returns the said canopy and ribs to the closed position.

wherein there is further provided that the aforesaid internal screw contains an area of reduced diameter which is devoid of threads such that rotation of the aforesaid internal screw will not urge the aforesaid threaded nut pass this area of reduced diameter which is devoid of threads.

2. The umbrella of claim 1 in which it is further provided that the aforesaid threaded nut and the aforesaid internal screw are both provided with matching multiple lead threads.

3. An umbrella having a canopy and a frame of interconnected ribs and a means for the automatic opening and closing of the aforesaid ribs and canopy comprising:

a hollow outer cylinder provided with a slot or slots extending therethru along a portion of its length;

a collar which slides along the exterior surface of the aforesaid hollow outer cylinder;

a threaded nut located concentrically within the aforesaid hollow outer cylinder and the said threaded nut is attached to the aforesaid collar by means of a pin or pins extending through the slot or slots provided in the aforesaid hollow outer cylinder;

an internal screw threadably inserted at one of its ends into the aforesaid the threaded nut;

an electric motor having a driveshaft said motor being fixed relative to the aforesaid hollow outer cylinder said driveshaft being attached to said internal screw, a battery which provides electromotive energy for the aforesaid electric motor;

wherein, further, there is a provided a switch which in a first position regulates flow of electricity from the aforesaid battery such that the shaft of the aforesaid electric motor turns in a first direction which, in turn, rotates the aforesaid internal screw, thereby moving the aforesaid threaded nut in a direction which forces the aforesaid canopy and ribs from the closed position to an open position;

wherein, placement of the said switch in a second position regulates the flow of electricity from the aforesaid battery such the shaft of the aforesaid electric motor turns in a second direction opposite to the said first direction which, in turn, rotates the aforesaid internal screw thereby moving the aforesaid threaded nut a in direction which returns the said canopy and ribs to the closed position.

wherein the aforesaid pin or pins extending through an aforesaid slot or slots provided in the aforesaid hollow outer cylinder are manually engageable and unengageable from the aforesaid threaded nut.

4. The umbrella of claim 3 in which it is further provided that the aforesaid threaded nut and the aforesaid internal screw are both provided with matching multiple lead threads.

* * * * *